United States Patent [19]

van den Elzen et al.

[11] Patent Number: 4,533,279

[45] Date of Patent: Aug. 6, 1985

[54] METHOD FOR MAKING A FOUNDATION PILE

[75] Inventors: Lambertus W. A. van den Elzen, Ijssel; Adriaan van der Wouden, Bergambacht; Auke Meijer, Nigtevecht, all of Netherlands

[73] Assignee: Fundemantum B.V., Netherlands

[21] Appl. No.: 494,095

[22] Filed: May 12, 1983

[51] Int. Cl.[3] ..... E02D 5/36

[52] U.S. Cl. ..... 405/239; 405/236; 405/233; 405/241

[58] Field of Search ..... 405/236, 241, 239, 269, 405/240, 233

[56] References Cited

U.S. PATENT DOCUMENTS

| | | | |
|---|---|---|---|
| 3,084,518 | 4/1963 | Hochstrasser | 405/236 |
| 3,206,935 | 9/1965 | Phares | 405/242 |
| 3,438,212 | 4/1969 | Turzillo | 405/236 |
| 3,540,225 | 11/1970 | Muller | 405/242 |
| 3,802,208 | 4/1974 | Granholm et al. | 405/269 |
| 3,842,608 | 10/1974 | Turzillo | 405/236 |
| 3,852,971 | 12/1974 | Phares | 405/236 |
| 3,886,754 | 6/1975 | Turzillo | 405/239 |
| 3,962,879 | 6/1976 | Turzillo | 405/236 |

FOREIGN PATENT DOCUMENTS

| | | | |
|---|---|---|---|
| 672141 | 10/1963 | Canada | 405/236 |

*Primary Examiner*—Dennis L. Taylor

[57] ABSTRACT

A method is provided for making a foundation pile comprising a cylindrical tube (1) with one or more helically extending blades (14,15) at its lower end to which a hardening liquid is supplied that is conducted in such a manner that it penetrates the soil below the helical blade part or parts and along the tube wall (2) thereabove at 13. Said hardable liquid serves as means for removing the friction between pile and soil during screwing in the soil.

5 Claims, 1 Drawing Figure

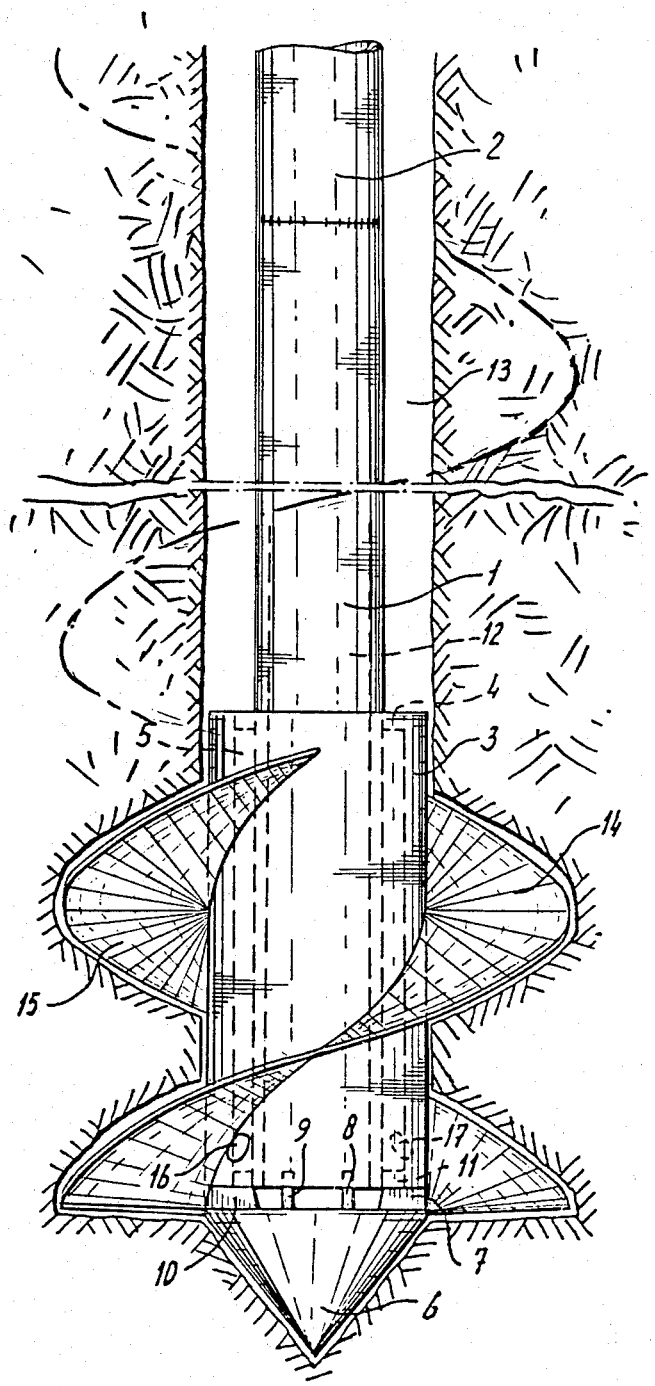
2
13
1
12
4
5
3
14
15
9
8
17
16
11
10
7
6

METHOD FOR MAKING A FOUNDATION PILE

The invention is related to a method for making a foundation pile in which a cylindrical tube that at the outer side of the lower end having a helically extending blade, is screwed under vertical load into the soil while at the same time through the hollow tube a hardening liquid is supplied that flows out near the lower helical face, which tube with helical blade remains in the soil.

Such a method is known from the Dutch Patent Application No. 76.08927, laid open for public inspection. In this known method a tube is used with relatively great diameter that on its outer face at several places, in particular on the lower part of the tube has been provided with helical blades of small radial width, in which at the spot of the helical blades injection tubes are provided through which a hardening liquid, such as grout, can be injected into the soil. The tube is provided with several helical blades positioned one above the other, that mix the liquid injected according to the helical screw threads with the soil by which, after hardening of the mass, a broaden foot is formed. This known method is expensive. This is a result of the fact that the foundation pile in essence is shaped by a steel tube of great diameter and for introducing this tube into the ground a lot of energy is required as result of the high friction of the outer surface of the tube.

The invention firstly aims to provide a method that requires substantially less energy and that admits an effective use of material.

This aim according to the invention is obtained in the first place by the fact that the hardening liquid is conducted in such a manner that this penetrates the soil below the helical blade part and along the tube wall present above the helical blade part.

Besides the injection at the spot of the screw blade or screw blades respectively according to the invention also is injected downwardly and upwardly, in such a manner that the whole tube body is surrounded by the liquid mass that still is not hardened. The injection downwardly has as result that the grain tension below and along the tip of the pile is reduced and possibly even is removed for the greater part, while the friction along the shaft of the pile that is formed by the pile by liquid penetrating between the soil and the shaft is removed nearly completely. By this fact it becomes possible to introduce the pile into the soil under a fraction of the energy that formerly was required for instance a quarter of the energy as usual upto now, while the shaft of the pile formed by the tube may have a substantial smaller diameter so that this shaft with surrounding mass may form a slender foundation pile.

The invention also is related to a tube for embodying the method according to the invention and this tube is characterized in that the helical blade or helical blades are mounted on a jacket that is connected to the lower end of the tube while leaving clear an upwardly and downwardly partly open ring shaped space, that is in connection with the inner side of the tube and at the lower end of the jacket and/or tube supports a cone shaped part that leaves the downwardly directed outflow opening free. The part of the helical blades in contradiction with the method according to the above mentioned Dutch Patent Application No. 76.08927 is restricted to a short lower part that is determined by the length or the height of the jacket on which the screw blade or screw blades respectively, preferable two, extend continuously. This jacket takes care of the enlargement of the diameter so that the outstreaming liquid surrounds the tube part or shaft present above the jacket with a layer of relatively great thickness. Downwardly the liquid flows along the base of the pile cone into the soil so that the tube together with the helical blade part during introducing into the soil rotates in a slurrylike mass. Penetrations to sufficient depth in the supporting layer can be realized therewith in a relatively simple way in which the great amount of the hardable liquid streaming out upwardly and downwardly and through the openings below the helical blades after reaching the desired position takes care of the fact that by hardening of the liquid a pile is obtained comprising a tube with small diameter, a helical part formed by the screw blades and a jacket out of hardened material, which material before hardening, there where is seems to be necessary, has penetrated in a softer part or is mixed therewith respectively. This hardened layer moreover takes care of the protection of the tubes against corrosion. Such a pile which is slender per se besides a tip supporting ability also has supporting ability as result of adherence with regard to the surrounding ground.

It is remarked that it is known per se to introduce a hardable liquid through a tube provided with screw blades into the soil in particular during the formation of a screw pile in which after screwing into the soil the tube provided with screw blades is withdrawn while at the same time the shaped hollow space is filled up.

The invention will now be discussed with the aid of a drawing.

This drawing shows in side view a device for embodying the method according to the invention.

The drawing shows a tube 1, that may comprise successively mutually connected sections that are mutally connected by welding, such as the parts 1 and 2. This tube at the lower end is surrounded by a jacket 3 that at the upper side is connected to the tube by radially extending spacers 4, while leaving outflow openings. The jacket 3 together with the tube forms a ring shaped space 5.

At the lower end a pile cone 6 is present that by means of radial ribs 7, 8, 9 and 10 is connected to the jacket 3, which ribs 7 to 9 inclusive may have an upwardly directed notch part 11 that in the lower parts mutually spaces the jacket and the tube.

By this manner of connecting an outflow opening is obtained so that the liquid material supply through the inner 12 of the tube may flow out between ribs 7 to 10 inclusive and may flow out downwardly along the upper edge of the pile cone 6. This liquid may flow upwardly through the ring shaped space 5 and between the spacers 4 by flowing upwardly and may surround the tube 1, 2 with a layer 13.

The jacket 3 supports two helical blades 14 and 15 of which the outer edges are present on the outer diameter that is three- to four-fold the outer diameter of the tube 1.

Below the helical blades 14, 15 an outflow opening 16 and/or 17 respectively may be present through which liquid at the spot of the helical blades can be injected.

This liquid may be grout, water glas, mortar or an other self hardening material.

We claim:

1. A tube for making a foundation pile in the soil which is vertically screwed into the soil, said tube having at least one screwing blade at its lower end, an orifice for hardenable liquid below the lower face of the blade, and a cone closing the lower end of said tube, characterized in that a cylindrical jacket is connected to the lower end of the tube by means of spacers so as to form an annular free space between the outer wall of the tube and the inner wall of the jacket, said space being open at the top and at the bottom and being in communication with the inside of the tube to supply said hardenable liquid to said space, and said blade being attached to said cylindrical jacket.

2. A tube according to claim 1, characterized in that at least a portion of said spacers are at the lower end of the jacket and tube and comprise radially extending blades interconnecting the lower ends of the tube and jacket and connecting said cone to said lower ends whereby to leave a space between the top of the cone and the lower edges of the jacket and the tube respectively.

3. A tube according to claim 2, characterized in that said jacket has at least one opening below the blade comprising said orifice and connecting the outer side of the jacket with said annular free space.

4. A tube according to claim 1, characterized in that the blade has an outer diameter which is three to four times the outer diameter of the tube.

5. A method of making a foundation pile in the soil, comprising the steps of: screwing a tube having at least one screwing blade on the outer surface of only the lower end thereof into the soil under axial load, supplying hardenable liquid downwardly of the screwing blade during said screwing step, leaving the tube and the blade in the soil to form a portion of the foundation pile; mounting the screwing blade on a mounting means having an outer cross-sectional dimension larger than the outer cross-sectional dimension of the tube; forming a space of substantial thickness between the tube and the soil and having a cross-sectional dimension defined by the outer cross-sectional dimension of the blade mounting means, said space being located above the blade mounting means, and flowing hardenable liquid during said screwing step upwardly above the screwing blade mounting means into the space between the tube and the soil.

* * * * *